US007501364B2

(12) United States Patent
Bouckaert et al.

(10) Patent No.: US 7,501,364 B2
(45) Date of Patent: Mar. 10, 2009

(54) ABSORBENT NON-WOVEN FELT MATERIAL AND METHOD OF MAKING SAME

(75) Inventors: Thomas V. Bouckaert, Woonsocket, RI (US); Richard A. Leroux, Woonsocket, RI (US)

(73) Assignee: Bouckaert Industrial Textiles, Inc., Woonsocket, RI (US)

( * ) Notice: Subject to any disclaimer, the term of this patent is extended or adjusted under 35 U.S.C. 154(b) by 0 days.

(21) Appl. No.: 11/564,338

(22) Filed: Nov. 29, 2006

(65) Prior Publication Data

US 2008/0124533 A1 May 29, 2008

(51) Int. Cl.
*D04H 1/46* (2006.01)
*D04H 3/10* (2006.01)
*D04H 5/02* (2006.01)

(52) U.S. Cl. ..... 442/405; 442/402; 442/403; 442/409; 442/411; 442/415; 442/416; 264/123

(58) Field of Classification Search ..... 442/402, 442/405, 409, 415, 416, 403; 264/123
See application file for complete search history.

(56) References Cited

U.S. PATENT DOCUMENTS

| | | | | |
|---|---|---|---|---|
| 3,523,059 | A | 8/1970 | Coates | |
| 4,100,324 | A * | 7/1978 | Anderson et al. | 442/344 |
| 4,426,417 | A * | 1/1984 | Meitner et al. | 428/195.1 |
| 4,587,154 | A * | 5/1986 | Hotchkiss et al. | 428/195.1 |
| 5,418,031 | A | 5/1995 | English | |
| 5,554,238 | A | 9/1996 | English | |
| 5,652,048 | A | 7/1997 | Haynes et al. | |
| 6,632,501 | B2 | 10/2003 | Brownstein et al. | |
| 2006/0141260 | A1 * | 6/2006 | Haque et al. | 428/412 |

FOREIGN PATENT DOCUMENTS

| | | |
|---|---|---|
| WO | 97/23678 | 7/1997 |

* cited by examiner

*Primary Examiner*—Norca L Torres-Velazquez
(74) *Attorney, Agent, or Firm*—Rankin, Hill & Clark LLP

(57) ABSTRACT

The present invention provides a non-woven felt material that includes a blend of cotton shoddy and synthetic fibers, and a method of making the same. The blend of cotton shoddy and synthetic fibers is carded and needled to form a batt. The batt is compacted and unified into its stable final shape by heating and soft-pressing, which causes at least a portion of the synthetic fibers to soften and/or melt and thereby bond the needled cotton shoddy and synthetic fibers together. The non-woven felt material according to the invention is strong, tear resistant, yet provides a non-slip, cushioned walking surface that readily absorbs and contains spilled oils, water and/or glycols.

14 Claims, No Drawings

ABSORBENT NON-WOVEN FELT MATERIAL AND METHOD OF MAKING SAME

FIELD OF THE INVENTION

The present invention relates to an absorbent non-woven felt material and a method of making the same. More particularly, the present invention relates to a non-woven felt material that can be used as a disposable mat for absorbing liquids such as oils, water and/or glycols, and a method of making the same.

BACKGROUND OF THE INVENTION

In many industries (e.g., steelmaking, metalworking and automotive), it is necessary to dispose absorbent matting on the floor to collect spilled oils, water and/or coolants (e.g., glycols) and thereby prevent slips and falls. Traditionally, rolled felt matting has been used in such applications. Although many materials can and are used, the typical felt matting material used in such applications consists of a blend of cotton shoddy and synthetic fibers that are held together with a light coating of latex, which is applied as an aqueous emulsion and then dried. The latex coating provides strength to the rolled felt material, but reduces the absorbency of the material and tends to break down upon long-term exposure to water and glycol-containing coolants. Relatively soon after such conventional latex-containing absorbent felt materials become saturated with spilled fluids, they must be taken up and discarded before they break down.

SUMMARY OF THE INVENTION

The present invention provides a non-woven felt material that can be used as a disposable mat for absorbing liquids such as oils, water and/or glycols. The non-woven felt material according to the invention comprises a blend of cotton shoddy and synthetic fibers. In accordance with the method of the invention, the blend of cotton shoddy and synthetic fibers is carded and needled to form a batt. The batt is compacted and unified into its stable final shape by heating and soft-pressing, which causes at least a portion of the synthetic fibers to soften and/or melt and thereby bond the needled cotton shoddy and synthetic fibers together. No latex must be applied to the batt to bind it together. The non-woven felt material according to the invention is strong, tear resistant, yet provides a non-slip, cushioned walking surface that readily absorbs and contains spilled oils, water and/or glycols.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE PREFERRED EMBODIMENTS

The non-woven felt material according to the invention comprises a blend of:

- from about 40% to about 60% by weight, and more preferably about 45% to about 55% by weight, and most preferably about 50% by weight, of cotton shoddy;
- from about 25% by weight to about 35% by weight, and more preferably about 27.5% to about 32.5% by weight, and most preferably about 30% by weight, of polyolefin fibers; and

- from about 15% by weight to about 25% by weight, and more preferably about 17.5% to about 22.5% by weight, and most preferably about 20% by weight, of polyester fibers.

Cotton shoddy is available from many suppliers worldwide and is typically formed of recycled textile fibers. It will be appreciated that the cotton shoddy used in the invention can and most often will include small amounts (typically less than 15% by weight) of various non-cotton fibers such as synthetic fibers (e.g., nylon) and natural fibers (e.g., wool). The cotton shoddy can but need not be bleached or colored as desired.

The polyolefin fibers used in the invention are preferably selected from the group consisting of polypropylene fibers, polyethylene fibers, mixtures of polypropylene and polyethylene fibers, and propylene/ethylene copolymer fibers. Polypropylene fibers, which are used in a variety of textile and carpet applications, are presently most preferred for use in the invention. The polypropylene fibers are preferably formed of virgin polypropylene and have a denier of from about 3 to about 25, and most preferably about 15. It will be appreciated that all or a portion of the polyolefin fibers can be recycle grade fibers, provided the fibers are of the appropriate denier. The polyolefin fibers should have an average length suitable for use in forming a non-woven batt by carding and needling. The color of the polyolefin fibers is not critical, but mixed color polypropylene fibers are presently preferred.

The polyester fibers used in the invention are preferably formed of polyethylene terephthalate (PET), although other polyesters can also be used. The polyester fibers preferably have a denier of from about 3 to about 25. The polyester fibers should have an average length suitable for use in forming a non-woven batt by carding and needling. The polyester fibers are preferably formed of virgin material, but recycled polyester fibers may be used. The color of the polyester fibers is not critical.

The cotton shoddy, polyolefin fibers and polyester fibers are thoroughly blended together in a five box mechanical weigh blend line and carded using conventional carding equipment to form a continuous web. In the carding process, which is well known in the art, the blend of cotton shoddy, polyolefin fibers and polyester fibers are held by one surface while another surface combs the blend, causing individual fiber separation. Most carding equipment utilizes a large rotating metal cylinder that is covered with carding cloth. The carding cloth comprises a plurality of needles, wires, or fine metallic teeth that are embedded in a heavy cloth or in a metallic foundation. An endless belt of a cast iron flats is typically positioned along the top of the cylinder. Alternating rollers and stripper rolls may cover the top of the cylinder in a roller-top card. After the blend of fibers have been pulled and teased apart, they are deposited back on the cylinder in a machine direction to form a coherent web below the surface of the needles, wires, or fine metallic teeth of the carding cloth on the cylinder. The continuous web is then doffed from the surface of cylinder by a doffer roller and deposited on a moving belt in the form of a continuous batt. The weight and thickness of the batt determines the weight and thickness of the resulting non-woven felt material, and can be adjusted as desired.

The continuous batt is advanced on the moving belt to a needle press. Needle presses, which are well known in the art, utilize a densely arranged group of needles that are mounted on a vertically reciprocating platen. Upon downward movement, the needles transversely penetrate the batt. Needling is rapid and repetitive, and each portion of the batt is penetrated many times to intertwine and interlace the fibers, causing them to mechanically interlace and interlock. The number of needles per unit area and the number of needle strokes per minute may be varied, as desired. The type of needle press used is not critical. After needling, the fibers comprising the batt will be randomly oriented and mechanically intertwined and interlocked.

In accordance with the invention, after needling, the needled batt is slightly compacted and unified into a stable final shape by heating and soft pressing, preferably using a heated three-roll calender mill. The peak temperature of the batt during heating is preferably just above the melting point of the polyolefin fibers present in the batt. Thus, as the batt passes through the heated calender rolls, the temperature rapidly rises above the melting point of the polyolefin fibers, which soften and/or melt while interlaced with the cotton shoddy and polyester fibers. The polyester fibers may also soften and/or melt as the batt passes through the calender roll. After exiting the calender roll, the batt quickly cools to a temperature below the melting point of the polyolefin fibers, causing them to solidify and thereby serve as an adhesive that bonds needled cotton shoddy and synthetic fibers together to form the non-woven felt material according to the invention. The non-woven felt material according to the invention can be wound onto rolls or die cut into sheets, as desired.

In the preferred embodiment of the invention, the non-woven material has a final thickness of about 0.125"±10% and weighs about 12±10% ounces per square yard ("opsy"). At this weight and thickness, the non-woven material according to the invention is ideally suited for use as a floor matting material to absorb minor fluid leaks and spills in manufacturing production areas where industrial machinery is operating. The non-woven material provides a non-slip, tear resistant, comfortable cushioned walking surface that will not "bunch up" or wrinkle during use. Furthermore, the non-woven material can absorb oils (e.g., motor oils, hydraulic oils, lubricants etc.), water and coolants (e.g., glycols and cutting fluids). The non-woven material will absorb approximately 10 times its weight in oil, water and/or glycol.

Because the non-woven material is held together using melt-bonded polyolefin fibers, no latex must be applied to provide strength. The non-woven latex-free material according to the invention thus does not break down and lose significant tensile strength and structural integrity upon exposure to oils, water, glycols and mixtures of the foregoing. The material will generally retain approximately 80% of its original tensile strength after absorbing its maximum capacity of fluids (saturating the material by soaking for 4 hours).

Floor matting formed from the non-woven material according to the invention can be taken up and disposed of on a regular maintenance and housekeeping schedule or on an as-needed basis depending upon the amount of fluid absorbed and the degree of surface wear. The non-woven material, when highly saturated with oils, waters and/or coolants, can be pressed to recover some the fluids before disposal. In some instances, it may be possible to reuse the pressed non-woven material one or more times before final disposal.

It will be appreciated that in addition to being useful in absorbent floor matting applications, the non-woven material according to the invention could also be produced in thicker dimensions for use as temperature and sound insulation, particularly in automotive applications. Due to its high crush resistance, the non-woven material according to the invention is also suitable for use as carpet underlayment. Other potential uses include as padding blankets, particularly in the shipping industry.

The following example is intended only to illustrate an embodiment of the invention and should not be construed as imposing limitations upon the claims.

EXAMPLE 50 parts by weight of processed cotton shoddy having a mixed denier of 3-15, 30 parts by weight of mixed color virgin polypropylene staple fibers having a mixed denier of about 3 to 15, and an average length of about 3 inches, and 20 parts by weight of virgin polyester staple fibers having a regenerated denier of about 6 and an average length of about 3 inches, were thoroughly blended together using a five box mechanical weigh blend line and then fed to a hopper.

The blend of cotton shoddy and synthetic fibers was fed from the hopper to a 20/30/20 Double Doffer P&S Garnett carding machine and carded to form a continuous batt. The continuous batt had a weight of about 14 opsy.

The continuous batt was then needled using a Fehrer NL-9 needle loom. The continuous bat moved through the needle press at a speed of 12 feet per minute. The needle press operated at 600 strokes per minute. The loom density was 125 needles per inch. After needling, the batt had a thickness of about 0.200".

The needled batt was heated and pressed using a three-roll Verduin 80" 100 ton three roll calender. The temperature setting for all three rolls was 425° F. The needled batt moved through the three-roll calender at a speed of 7 yards per minute. After passing through the three-roll calender, the non-woven material was wound onto rolls. The non-woven material had a thickness of about 0.140±10% inches and a weight of about 12±7% opsy.

Sheets of the non-woven material were tested to determine the maximum absorbency capacity of the material for specific fluids pursuant to ASTM D-461-21. The non-woven material absorbed 9.2 times its own volume of hydraulic oil, 5.9 times its own volume of water, or 7.2 times its own volume of coolant.

The tensile strength of the material was tested in a dry condition and a "wet" condition as provided in ASTM D-461-21. In the dry condition, the non-woven material exhibited a minimum tensile strength of 17 pounds per square inch ("psi") and a maximum tensile strength of 36 psi. In the "wet" condition, the non-woven material exhibited a minimum tensile strength of 8.6 psi and a maximum tensile strength of 34 psi.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A non-woven felt material comprising a blend of:

from about 40% to about 60% by weight of cotton shoddy;

from about 25% by weight to about 35% by weight of polyolefin fibers; and from about 15% by weight to about 25% by weight of polyester fibers;

wherein the cotton shoddy, polyolefin fibers and polyester fibers are randomly oriented and mechanically intertwined and interlocked in a sheet structure, and wherein the sheet structure is unified and stabilized by temporarily heating and soft pressing the sheet structure at a temperature sufficient to at least partially melt bond the polyolefin fibers to the cotton shoddy and polyester fibers throughout the entire sheet structure, wherein the non-woven felt material has a thickness of about 0.125±10% inches and a weight of about 12±10% ounces per square yard, and wherein the non-woven felt material is latex-free.

2. The non-woven felt material according to claim 1 wherein the polyolefin fibers comprise polypropylene fibers.

3. The non-woven felt material according to claim 2 wherein the polypropylene fibers have a denier within the range of from about 3 to about 25.

4. The non-woven felt material according to claim 1 wherein the polyester fibers comprise polyethylene terephthalate fibers.

5. The non-woven felt material according to claim 4 wherein the polyethylene terephthalate fibers have a denier within the range of from about 3 to about 25.

6. The non-woven felt material according to claim 1 wherein the blend of cotton shoddy, polyolefin fibers and polyester fibers comprises:

from about 45% to about 55% by weight of cotton shoddy;

from 27.5% to about 32.5% by weight of polypropylene fibers having a denier within the range of from about 3 to about 25; and from about 17.5% to about 22.5% by weight of polyethylene terephthalate fibers having a denier within the range of from about 3 to about 25.

7. A floor mat for absorbing oils, water and/or coolants comprising a latex-free non-woven felt material comprising a blend of:

from about 45% to about 55% by weight of cotton shoddy;

from 27.5% to about 32.5% by weight of polypropylene fibers having a denier within the range of from about 3 to about 25; and from about 17.5% to about 22.5% by weight of polyethylene terephthalate fibers having a denier within the range of from about 3 to about 25;

wherein the blend of cotton shoddy, polyolefin fibers and polyester fibers are randomly oriented and mechanically intertwined and interlocked in a sheet structure, wherein the sheet structure is unified and stabilized by temporarily heating and soft pressing the sheet structure at a temperature sufficient to at least partially melt bond the polyolefin fibers to the cotton shoddy and polyester fibers throughout the entire sheet structure, and wherein the latex-free non-woven felt material has a thickness of about 0.125±10% inches and a weight of about 12±10% ounces per square yard.

8. The floor mat according to claim 7 wherein the floor mat retains at least about 80% of an as-manufactured tensile strength after having been saturated for a period of 4 hours with a substance selected from the group consisting of oils, water, coolants and mixtures thereof.

9. A method of making a non-woven felt material comprising:

contacting from about 40% to about 60% by weight of cotton shoddy, from about 25% by weight to about 35% by weight of polyolefin fibers, and from about 15% by weight to about 25% by weight of polyester fibers together to form a blend of fibers;

carding the blend of fibers to form a carded web;

needling the carded web to form a needled batt in which the cotton shoddy, polyolefin fibers and polyester fibers are randomly oriented and mechanically intertwined and interlocked; and temporarily heating and soft pressing the needled batt at a temperature sufficient to at least partially melt bond the polyolefin fibers to the cotton shoddy and polyester fibers throughout the entire needled batt and thereby form a latex-free unified stable sheet structure having a thickness of about 0.125 ±10% inches and a weight of about 12±10% ounces per square yard.

10. The method of making a non-woven felt material according to claim 9 wherein the polyolefin fibers comprise polypropylene fibers.

11. The method of making a non-woven felt material according to claim 10 wherein the polypropylene fibers have a denier within the range of from about 3 to about 25.

12. The method of making a non-woven felt material according to claim 9 wherein the polyester fibers comprise polyethylene terephthalate fibers.

13. The method of making a non-woven felt material according to claim 12 wherein the polyethylene terephthalate fibers have a denier within the range of from about 3 to about 25.

14. The method of making a non-woven felt material according to claim 9 wherein the blend of cotton shoddy, polyolefin fibers and polyester fibers comprises:

from about 45% to about 55% by weight of cotton shoddy;

from 27.5% to about 32.5% by weight of polypropylene fibers having a denier within the range of from about 3 to about 25; and from about 17.5% to about 22.5% by weight of polyethylene terephthalate fibers having a denier within the range of from about 3 to about 25.

* * * * *